US007630658B2

(12) United States Patent
Nishikawa

(10) Patent No.: US 7,630,658 B2
(45) Date of Patent: Dec. 8, 2009

(54) IMAGE FORMING APPARATUS WITH AN ADJUSTABLE CLEANING VOLTAGE

(75) Inventor: Akihiro Nishikawa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 264 days.

(21) Appl. No.: 11/691,282

(22) Filed: Mar. 26, 2007

(65) Prior Publication Data

US 2007/0286621 A1 Dec. 13, 2007

(30) Foreign Application Priority Data

Mar. 31, 2006 (JP) ..... 2006-096931

(51) Int. Cl.
*G03G 15/00* (2006.01)

(52) U.S. Cl. ..... 399/49; 399/71; 399/354

(58) Field of Classification Search ..... 399/49, 399/71, 354

See application file for complete search history.

(56) References Cited

U.S. PATENT DOCUMENTS

| | | | | |
|---|---|---|---|---|
| 5,559,593 | A | 9/1996 | Yoshinaga et al. | 355/296 |
| 5,960,228 | A * | 9/1999 | Budnik et al. | 399/8 |
| 6,522,856 | B2 | 2/2003 | Nakayama | 399/297 |
| 7,251,430 | B2 | 7/2007 | Nishikawa | |
| 2006/0083539 | A1 | 4/2006 | Nishikawa | |
| 2007/0059028 | A1 | 3/2007 | Nishikawa | |

FOREIGN PATENT DOCUMENTS

| | | | |
|---|---|---|---|
| JP | 4-36775 | A | 2/1992 |
| JP | 10-149033 | A | 6/1998 |
| JP | 3236442 | B2 | 9/2001 |
| JP | 2001-3058778 | A | 11/2001 |
| JP | 2002-207403 | A | 7/2002 |
| JP | 2005-17929 | A | 1/2005 |
| JP | 2005-266604 | A | 9/2005 |

* cited by examiner

*Primary Examiner*—David M Gray
*Assistant Examiner*—Bryan P Ready
(74) *Attorney, Agent, or Firm*—Fitzpatrick, Cella, Harper & Scinto

(57) ABSTRACT

An image forming apparatus includes a cleaning apparatus, which electrostatically removes toner remaining on the image bearing member after a toner image formed on the image bearing member is transferred onto a recording medium or the like; and a detecting device, which may be an optical sensor, which detects the toner image on the image bearing member. A detecting device adjuster adjusts at least a light quantity or gain of the detecting device.

8 Claims, 7 Drawing Sheets

IMAGE FORMING APPARATUS WITH AN ADJUSTABLE CLEANING VOLTAGE

FIELD OF THE INVENTION AND RELATED ART

An image forming apparatus includes a cleaning apparatus which electrostatically removes the toner remaining on the image bearing member after a toner image formed on the image bearing member is transferred onto recording medium or the like; and an optical sensor which optically detects the toner image on the image bearing member. More specifically, it relates to the adjustment of the amount by which light is emitted by the optical sensor.

An image forming apparatus which employs an intermediary transfer belt (image bearing member) and forms a color image on recording medium with the use of an electrophotographic process has been in practical use. In an operation carried out by this type of image forming apparatus, cyan, magenta, yellow, and black toner images are individually formed on a photosensitive drum (photosensitive drums), and are sequentially transferred (primary transfer) in layers onto the intermediary transfer belt, and then, the four color toner images are transferred together (secondary transfer) from the intermediary transfer belt onto recording medium, that is, the final recording medium.

Some image forming apparatuses which employ an intermediary transfer belt are provided with an optical sensor for optically detecting a test toner image on the intermediary transfer belt. The optical sensor is placed between the primary and secondary transfer points, facing the intermediary transfer belt. The optical sensor is provided for adjusting the density with which a toner image is formed on the photosensitive drum. The results of the detection by the optical sensor are fed back to the control portion of the image forming apparatus to control the primary charge voltage and development bias voltage.

An image forming apparatus which employs an intermediary transfer belt is provided with a cleaning apparatus for removing the toner remaining on the intermediary transfer belt after the secondary transfer. The cleaning apparatus is located between the secondary and primary transfer points in terms of the moving direction of the intermediary transfer belt.

One of the cleaning methods used by a cleaning apparatus, such as the above-mentioned one, is disclosed in Japanese Laid open Patent Application 2002 207403. According to this Japanese patent application, the cleaning apparatus is provided with a rotatable brush, and the secondary transfer residual toner on the intermediary transfer belt is adhered to the rotatable brush by rotating the brush while applying voltage to the brush. According to this cleaning method, the amount of the pressure and frictional force to which the intermediary transfer belt is subjected are extremely small, being therefore advantageous from the standpoint of the efficiency and stability in the driving of an intermediary transfer belt.

In the case of the above-mentioned cleaning method, that is, the cleaning method which applies a voltage to a cleaning brush, the cleaning performance of the brush is affected by the ambient temperature and humidity, degree of wear of electrostatic brush (fur brush), degree of damage to the electrostatic brush (fur brush), amount of the toner on the brush (fur brush), etc. Therefore, the proper (optimal) bias voltage for the electrostatic fur brush, that is, the bias voltage which most efficiently removes the secondary transfer residual toner from the intermediary transfer belt when applied to the electrostatic fur brush, changes in value.

Thus, at the start of each printing job or during one of the recording medium (paper) intervals, the amount of electrical current which flows while a preset voltage is applied to the brush is measured. Then, based on the result of the measurement, the voltage to be applied to the brush is adjusted. In consideration of the length of time an image forming operation has to be interrupted for this voltage adjustment, the voltage to be applied to the brush is adjusted every several thousands of prints.

After the voltage adjustment, the cleaning performance of the brush changes with an increase in the number of times prints are formed thereafter, and therefore, the amount by which toner is expelled onto the intermediary transfer belt from the brush increases.

However, the toner particles which were expelled from the brush to which voltage was being applied have a very low possibility of transferring onto final recording medium. Therefore, their effect upon the quality, in which a toner image will be formed on final recording medium, is at a practically harmless level.

However, the amount by which light is to be emitted from the optical sensor, and the gain of the optical sensor, are adjusted by projecting light from the optical sensor onto the intermediary transfer belt which is in the above-mentioned condition, it is possible that the optical sensor will be improperly set in the amounts of light and gain, because of the toner particles on the intermediary transfer belt. If an optical sensor which is wrong in the amounts of light and gain is used to adjust an image forming apparatus in the toner image density, it is possible that the image forming apparatus will be adjusted incorrectly in the toner image density.

SUMMARY OF THE INVENTION

The primary object of the present invention is to minimize the problem that an optical sensor cannot be properly adjusted in the amount of light and/or gain, because of the toner particles remaining on an image bearing member.

According to an aspect of the present invention, there is provided an image forming apparatus comprising a rotatable image bearing member for carrying a toner image; toner image forming means for forming the toner image on said image bearing member; transferring means for transferring the toner image from said image bearing member onto a recording material; a cleaning member for removing untransferred toner remaining on said image bearing member after the toner image is transferred onto the recording material, wherein said cleaning member is supplied with a cleaning voltage while contacting said image bearing member; voltage adjusting means for adjusting the cleaning voltage on the basis of a current which flows when said cleaning member is supplied with a voltage; a detecting device for optically detecting the toner image on said image bearing member at a detecting position; control means for controlling a toner image forming condition of said toner image forming means on the basis of a result of detection of said detecting device; detecting device adjusting means for adjusting at least a light quantity or gain of said detecting device, wherein said detecting device adjusting means, for its adjusting operation, is contacted to said cleaning member while a non-toner image region of said image bearing member is exposed to light, in a period from application, to said cleaning member, of a cleaning voltage adjusted by said voltage adjusting means to removal of the untransferred toner by said cleaning member.

These and other objects, features, and advantages of the present invention will become more apparent upon consideration of the following description of the preferred embodiments of the present invention, taken in conjunction with the accompanying drawings.

DETAILED DESCRIPTION OF PREFERRED EMBODIMENTS

Hereinafter, the color copying machine, which is an example of an image forming apparatus in accordance with the present invention, will be described in detail with reference to the appended drawings. The structure for an image forming apparatus in accordance with the present invention does not need to be limited to the one which will be described next. In other words, the present invention is also applicable to any image forming apparatus, which is partially or entirely different in structure from the image forming apparatus in this embodiment, as long as the image forming apparatus is structured to remove the toner particles remaining on the image bearing member with the use of a bias voltage.

Embodiment 1

Figure 1:
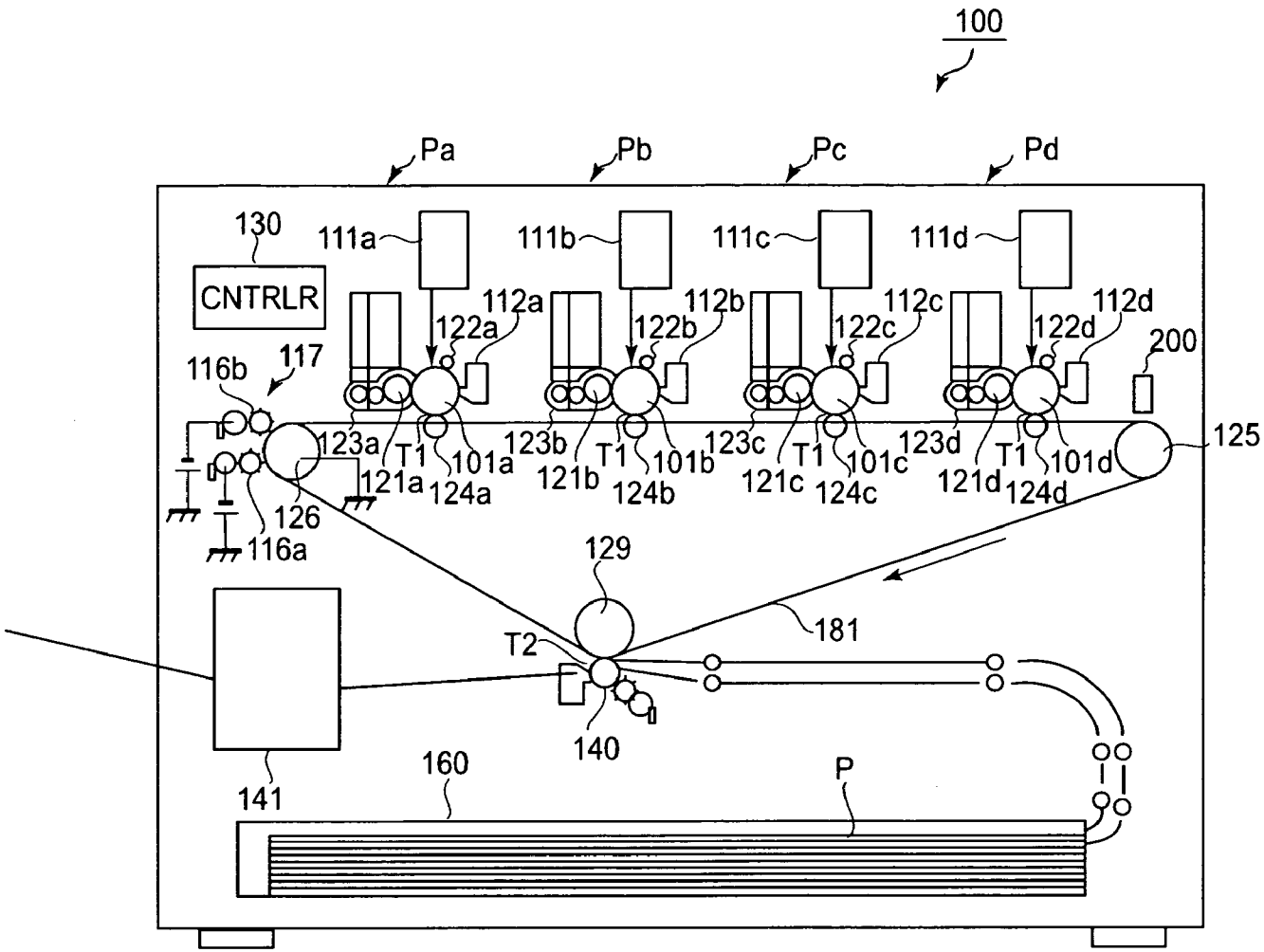
FIG. 1 is a schematic sectional view of the image forming apparatus according to a first preferred embodiment of the present invention, depicting the general structure thereof.
Figure 2:
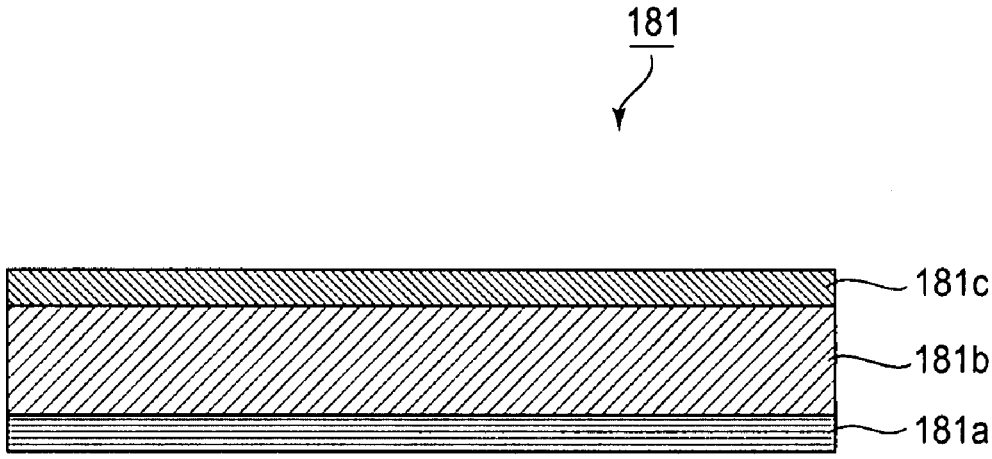
FIG. 2 is a sectional view of an intermediary transfer belt, depicting the general structure thereof.
Figure 3:
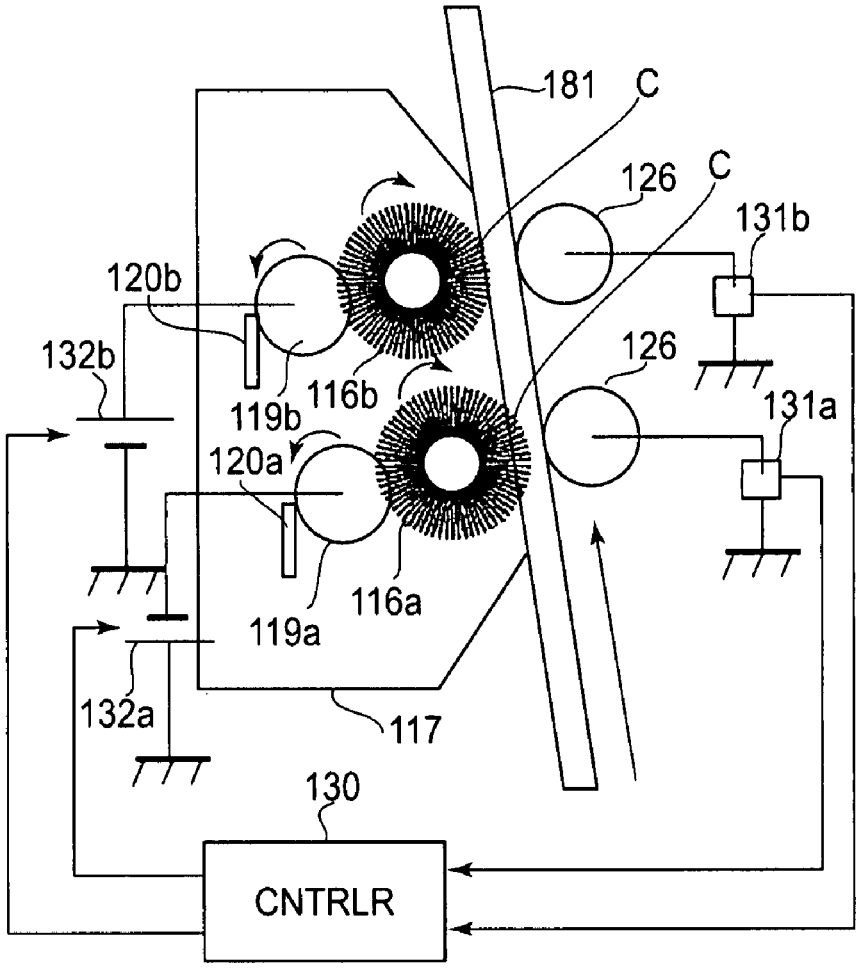
FIG. 3 is a schematic sectional view of a cleaning apparatus, depicting the general structure thereof.
Figure 4:
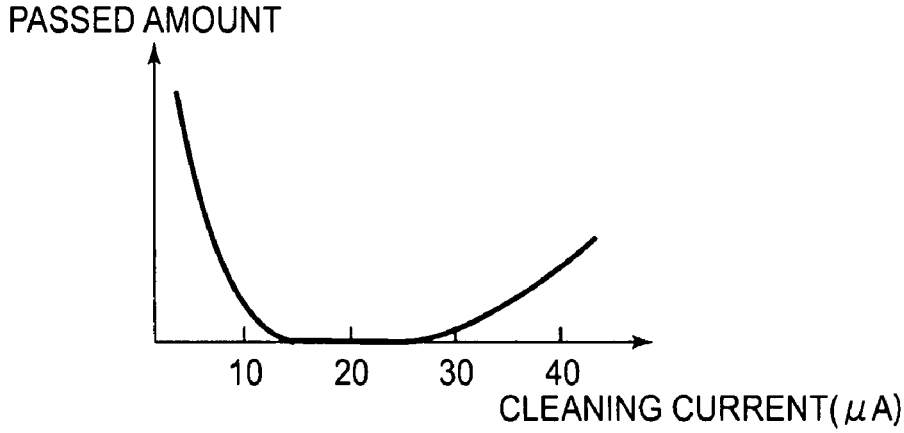
FIG. 4 is a graph depicting the relationship between the bias voltage and its effect.
Figure 5:
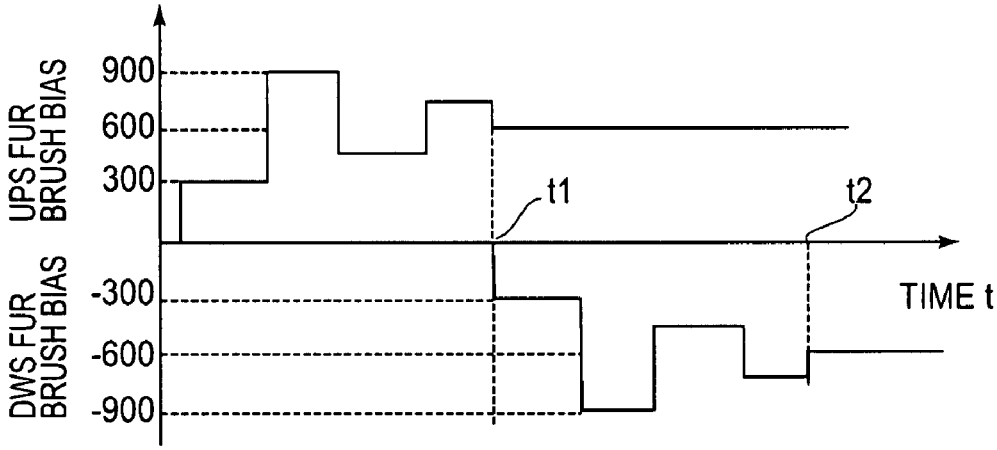
FIG. 5 is a timing chart for the control sequence for automatically adjusting bias voltages.
Figure 6:
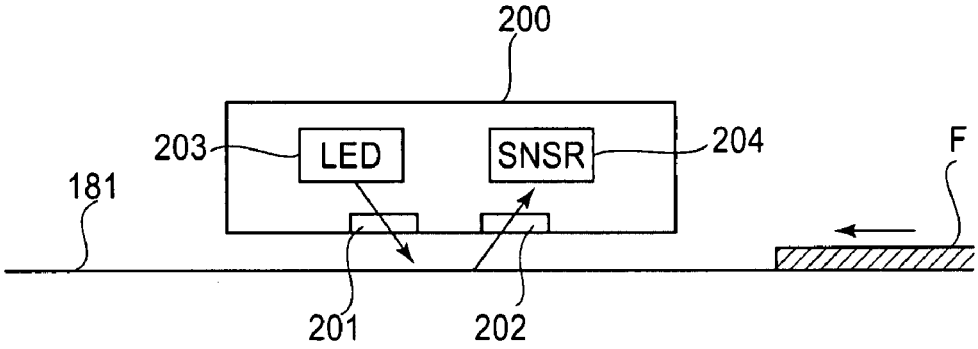
FIG. 6 is a schematic drawing of the optical sensor.
Figure 7:
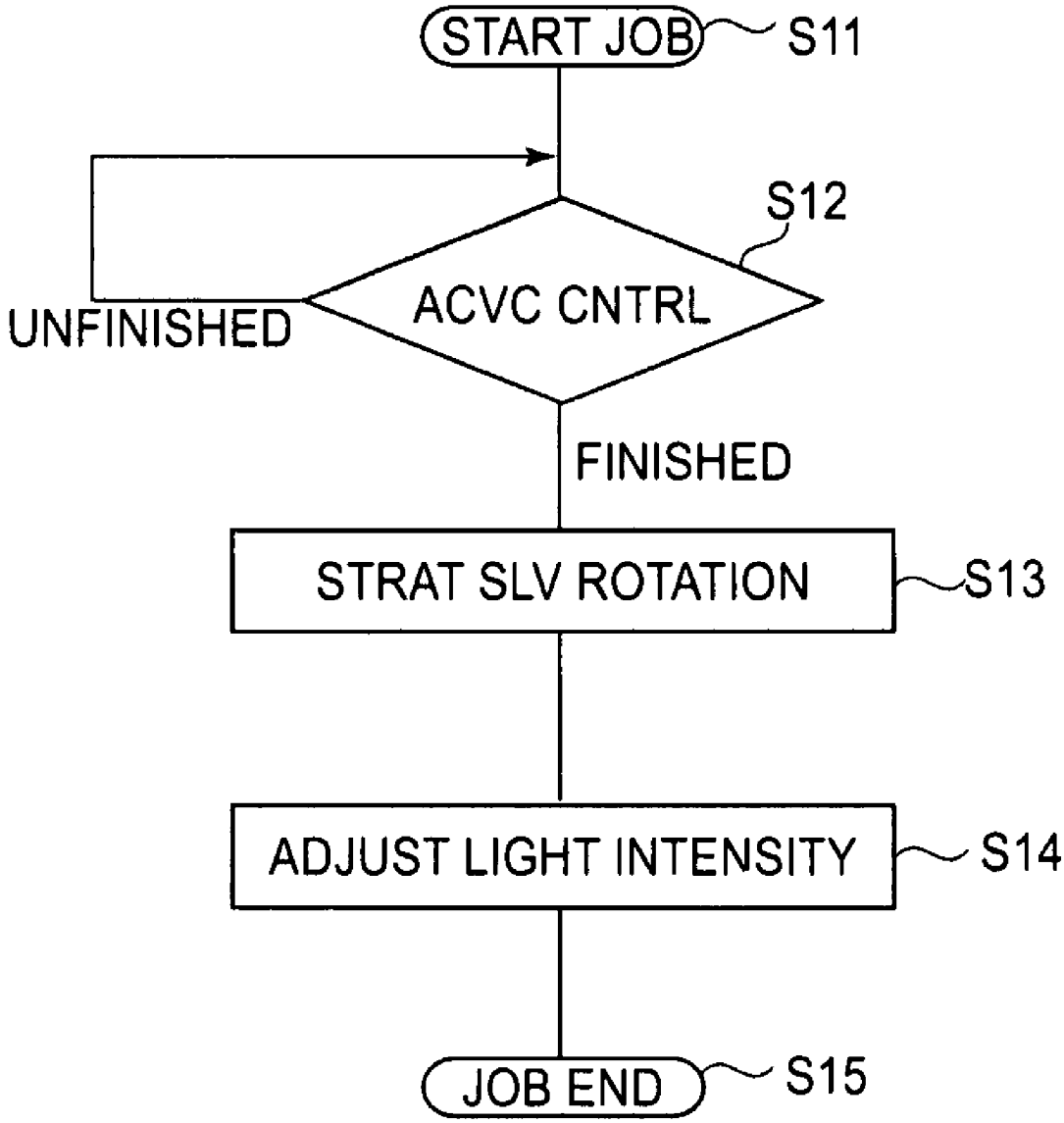
FIG. 7 is a flowchart of the control sequence in which various automatic adjustments are made.
Figure 8:
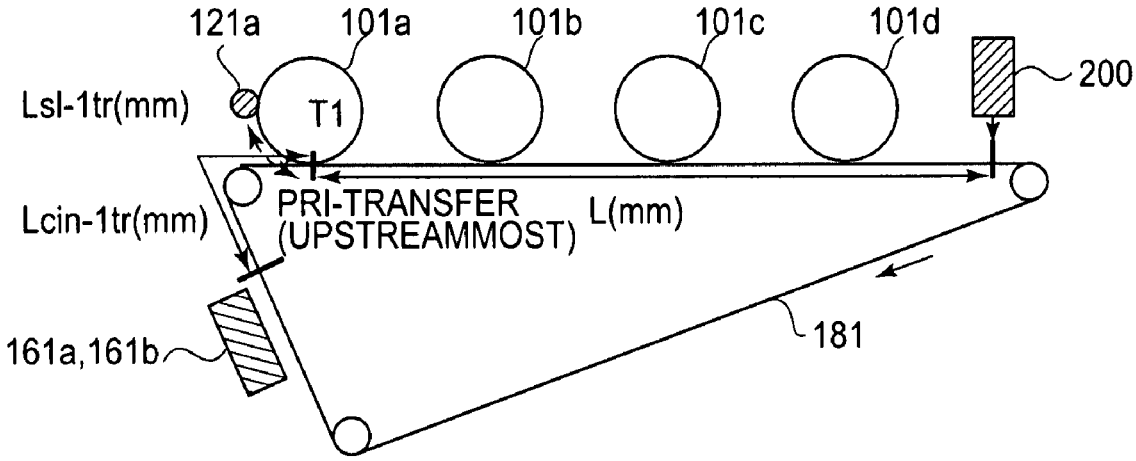
FIG. 8 is a schematic drawing showing the timing for starting up development sleeves.
Figure 9:
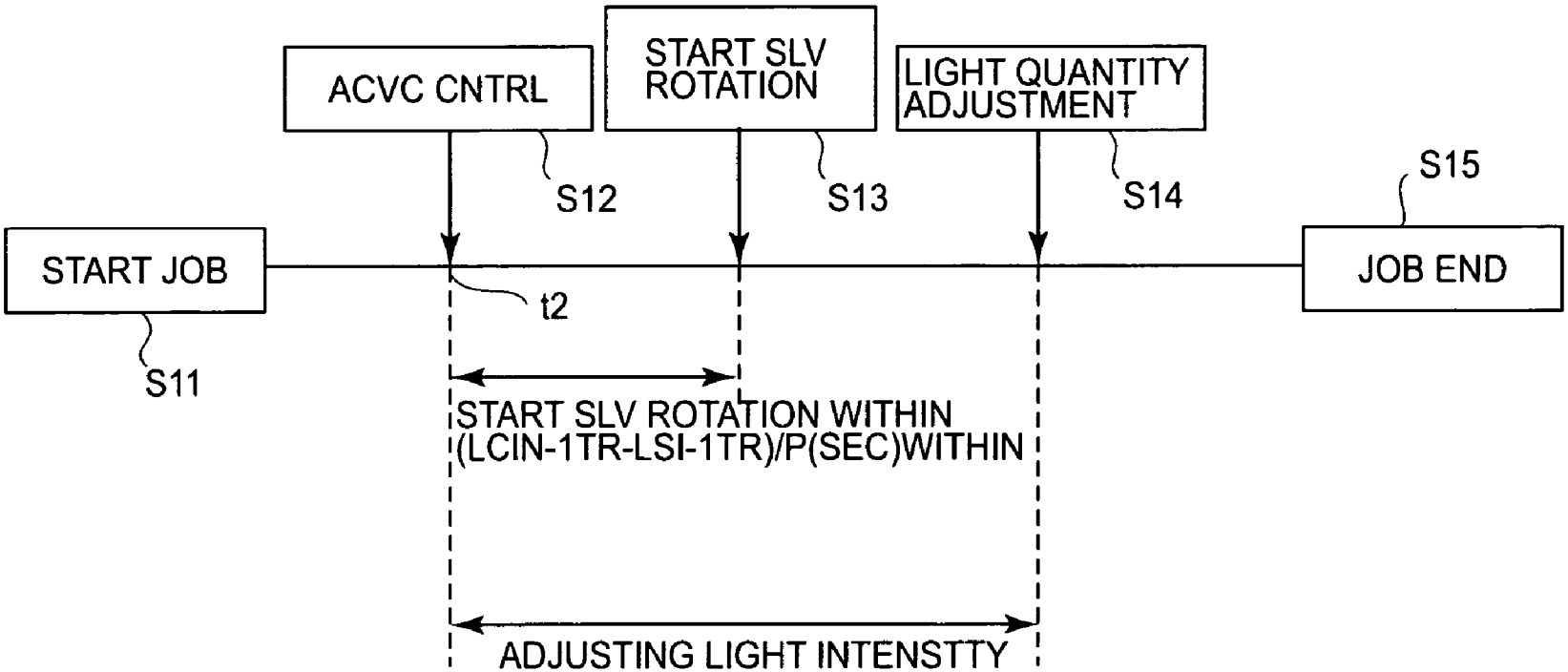
FIG. 9 is a timing chart of the control sequence in which various automatic adjustments are made.
Figure 10:
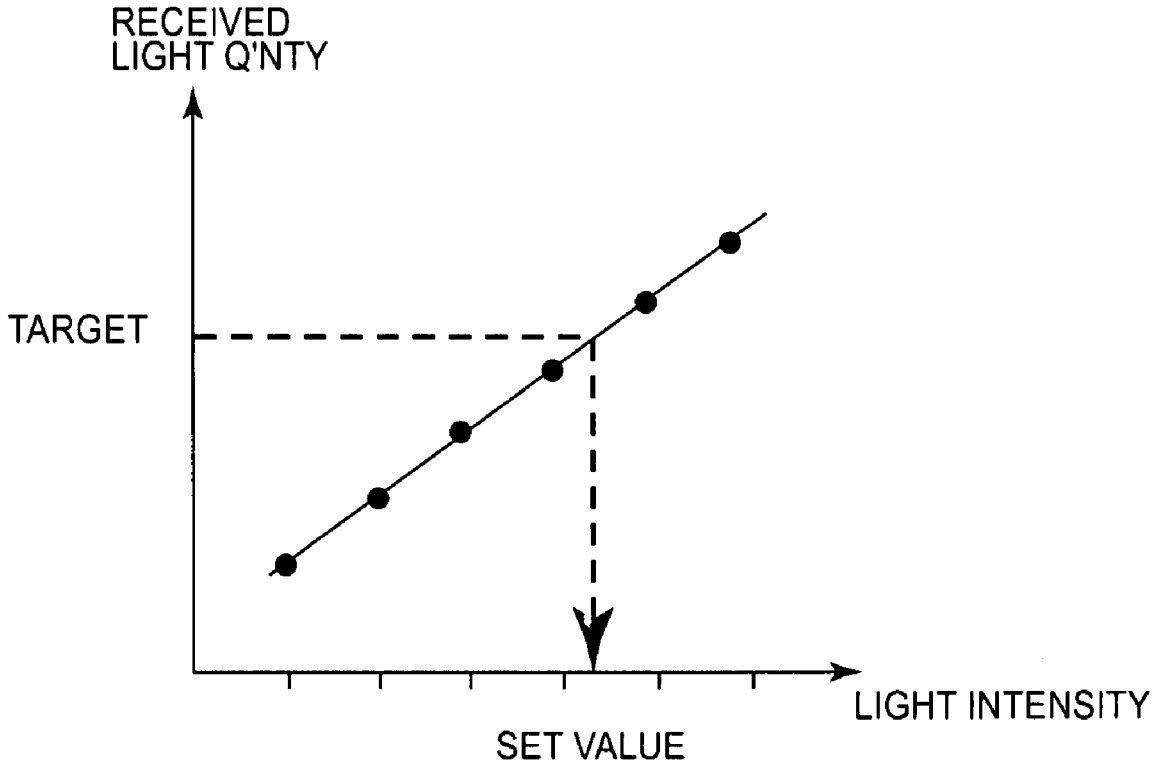
FIG. 10 is a graph used for the automatic adjustment of the amount by which light is emitted by the optical sensor.

FIG. 1 is a schematic sectional view of the image forming apparatus according to the first preferred embodiment of the present invention, and shows the general structure of the apparatus. FIG. 2 is a schematic sectional view of an intermediary transfer belt of the image forming apparatus, and shows the structure of the belt. FIG. 3 is a schematic sectional view of a cleaning apparatus of the image forming apparatus shown in FIG. 1, and shows the structure of the cleaning apparatus. FIG. 4 is a graph showing the relationship between the bias voltage and its cleaning effect. FIG. 5 is a timing chart for the automatic bias voltage adjustment sequence. FIG. 6 is a schematic drawing of the optical sensor. FIG. 7 is a flowchart of the control sequence in which various automatic adjustments are made. FIG. 8 is a schematic drawing showing the timing for starting up development sleeves. FIG. 9 is a timing chart of the control sequence in which various automatic adjustments are made. FIG. 10 is a graph used for the automatic adjustment of the amount by which light is emitted by the optical sensor.

Referring to FIG. 1, the image forming apparatus 100 shown according to the first embodiment is a copying machine of the tandem type. That is, it has four photosensitive drums 101*a*-101*d* juxtaposed in tandem. It also has an intermediary transfer belt 181. The four photosensitive drum 101*a*-101*d* are juxtaposed in parallel, being aligned in the direction parallel with the moving direction of the intermediary transfer belt 181. The intermediary transfer belt 181 is an elastic intermediary transfer medium, and is in the form of an endless belt. Its surface layer is formed of an elastic substance. It is wrapped around a driving roller 125, tension rollers 126, a backup roller 129, and circularly moves. The image forming apparatus 100 is provided with four image forming portions Pa, Pb, Pc, and Pd, which are arranged in a straight line along the top surface of the horizontal top portion of the intermediary transfer belt 181.

The image forming portion Pa is provided with a photosensitive drum 101*a* as a first image bearing member. The photosensitive drum 101*a* is an electrophotographic photosensitive member, which is in the form of a drum and is rotatably disposed. In the adjacencies of the peripheral surface of the photosensitive drum 101*a*, various processing devices, such as a primary charging device 122*a*, a developing device 123*a*, a cleaning apparatus 112*a*, etc., are disposed.

The other image forming portions (toner image forming means) Pb, Pc, and Pd are the same in structure as the image forming portion Pa. That is, they are provided with the photosensitive drums 101*b*, 101*c*, and 101*d*, primary charging devices 122*b*, 122*c*, and 122*d*, developing devices 123*b*, 123*c*, and 123*d*, and cleaning apparatuses 112*b*, 112*c*, and 112*d*, respectively.

In the developing devices 123*a*-123*d* in the image forming portions Pa-Pd, yellow, magenta, cyan, and black toners are stored, respectively. The image forming portions Pa, Pb, Pc, and Pd are different from each other only in the color (yellow, magenta, cyan, and black) of the toner images they form. Otherwise, they are identical (in structure) . Hereafter, therefore, the image forming portion Pa will be described in detail as the representative of the four image forming portions.

The photosensitive drum 101*a* is uniformly charged by the primary charging device 122*a*. Onto the uniformly charged area of the peripheral surface of the photosensitive drum 101*a*, a beam of light is projected from an exposing apparatus 111*a*, by way of a polygon mirror, etc., while being modulated with picture signals which represent the yellow component of an original. As a result, an electrostatic latent image is formed on the peripheral surface of the photosensitive drum 101*a*. Then, yellow toner is supplied to the electrostatic latent image on the peripheral surface of the photosensitive drum 101*a* from the developing device 123*a*, developing thereby the electrostatic latent image into a toner image of yellow color (yellow toner image).

As the photosensitive drum 101*a* is further rotated, the yellow toner image on the peripheral surface of the photosensitive drum 101*a* reaches the primary transferring portion T1, in which the peripheral surface of the photosensitive drum 101*a* is in contact with the intermediary transfer belt 181. In the primary transfer portion T1, transfer bias voltage is applied from a primary transfer roller 124*a*, which serves as a primary transferring apparatus. As a result, the yellow toner image is transferred (primary transfer) onto the intermediary transfer belt 181. The area of the intermediary transfer belt 181, which is holding the yellow toner image, is moved to the next image forming portion, or the image forming portion Pb, by the circular movement of the intermediary transfer belt 181. The primary transfer residual toner on the photosensitive drum 101*a*, that is, the toner which failed to be transferred from the photosensitive drum 101*a* by the primary transfer roller 124*a*, is removed by the cleaning apparatus 112*a*.

In the next image forming station, or the image forming station Pb, a magenta toner image is formed on the photosensitive drum 101*b* through the process similar to the process carried out in the image forming portion Pa, and then, is transferred (primary transfer) onto the intermediary transfer belt 181 so that it is layered on the yellow toner image on the intermediary transfer belt 181. Then, the area of the intermediary transfer belt 181, which is holding in layers the yellow and magenta toner images, is moved through the image forming portions Pc and Pd in the direction indicated by an arrow mark in the drawing. While this area of the intermediary transfer belt 181 is moved through the transferring portions T1 of the image forming portions Pc and Pd, cyan and black toner images are sequentially transferred (primary transfer) in layers onto the layered yellow and magenta toner images on the intermediary transfer belt 181.

By the time the toner images transferred (primary transfer) in layers on the intermediary transfer belt 181 reaches the secondary transferring portion T2, the recording medium P sent out of a paper feeder cassette 160 reaches the secondary transfer portion T2. In the secondary transferring portion T2, the four color toner images, different in color, are transferred together (secondary transfer) onto the recording medium P by the secondary transfer bias applied to the secondary transfer roller 140 as the secondary transferring apparatus. After the transfer (secondary transfer) of the four color toner images onto the recording medium P, the recording medium P, which is holding the four color toner images, is conveyed to a fixing portion 141. In the fixing portion 141, the four color toner images on the recording medium P are fixed to the surface of the recording medium P by being subjected to heat and pressure.

The secondary transfer residual toner particles, that is, the toner particles which failed to be transferred by the secondary transfer roller 140 and are remaining on the intermediary transfer belt 181, are removed by electrically conductive fur brushes 116*a* and 116*b*. The external additive particles on the surface of the intermediary transfer belt 181, which could not be removed even by the electrically conductive fur brushes 116*a* and 116*b*, are scraped away by an unshown cleaning web.

Next, the structures of the various sections of an image forming portion will be described in a logical order, using the image forming portion Pa as the representative of the four image forming portions. The photosensitive drum 101*a*, or the first image bearing member, is made up of an aluminum cylinder, and a layer of organic photoconductor coated on the peripheral surface of the aluminum cylinder. The photosensitive drum 101*a* is rotatably supported at its lengthwise ends, by the flanges with which the lengthwise ends of the photosensitive drum 101*a* are fitted, one for one. The photosensitive drum 101*a* is rotationally driven in the counterclockwise direction of FIG. 1, by the driving force transmitted to one of the lengthwise ends of the photosensitive drum 101*a* from an unshown motor.

The primary charging device 122*a* is an electrically conductive roller, to which the primary charge bias voltage is applied from an unshown electrical power source. As the primary charging device 122*a* is rotated in contact with the peripheral surface of the photosensitive drum 101*a* while the primary charge bias voltage is applied thereto, the peripheral surface of the photosensitive drum 101*a* is uniformly charged to the negative polarity.

The exposing apparatus 111*a* writes an electrostatic latent image on the peripheral surface of the photosensitive drum 101*a*. More specifically, a beam of laser light is projected from a semiconductor laser capable of emitting infrared light, while being modulated with picture signals from an unshown driving circuit, and is reflected by an unshown polygon mirror in such a manner to scan the peripheral surface of the photosensitive drum 101*a*. As a result, an electrostatic latent image is formed on the peripheral surface of the photosensitive drum 101*a*.

The developing device 123*a* has an unshown toner storage portion in which yellow toner is stored, and a development sleeve 121*a*. The native polarity to which the yellow toner is chargeable is negative. The development sleeve 121*a* is disposed close to the photosensitive drum 101*a* so that there is only a tiny gap between the peripheral surfaces of the development sleeve 121*a* and photosensitive drum 101*a*. The developing device 123*a* is also provided with a permanent magnet, which is disposed in the hollow of the development sleeve 121*a*. The development sleeve 121*a* is rotationally driven by an unshown driving portion, with yellow toner held to the peripheral surface of the development sleeve 121*a* by the magnetic field of the permanent magnet. To the development sleeve 121*a* , a development bias voltage is applied by an unshown development bias power source. As the yellow toner on the peripheral surface of the development sleeve 121*a* is driven by the electric field generated by the development bias voltage, it transfers onto the peripheral surface of the photosensitive drum 101*a*, in the pattern of the latent image on the peripheral surface of the photosensitive drum 101*a*. In the toner storage portions of the developing devises 123*a*, 123*b*, 123*c*, and 123*d*, listed in order from the upstream side in terms of the circular movement of the intermediary transfer belt 181, yellow, magenta, cyan, and black toners are stored, respectively.

On the inward side of the loop which the intermediary transfer belt 181 forms, the primary transfer rollers 124*a*, 124*b*, 124*c*, and 124*d* are disposed so that they oppose the photosensitive drums 101*a*, 101*b*, 101*c*, and 101*d*, respectively. The primary transfer roller 124*a* is connected to an unshown primary transfer bias power source, from which the primary transfer bias voltage (positive voltage) which is opposite in polarity to the native polarity of the yellow toner is applied to the primary transfer roller 124*a*. The primary transfer roller 124*a* locally charges the intermediary transfer belt 181, which is very high in electrical resistance, to a positive polarity, causing thereby the yellow toner on the peripheral surface of the photosensitive drum 101*a* to transfer onto the intermediary transfer belt 181.

The primary transfer rollers 124*a*-124*d* sequentially transfer (primary transfer) the color toner images (which are negative in polarity) on the photosensitive drums 101*a*-101*d*, with which the primary transfer rollers 124*a*-124*d* are in contact, respectively, effecting thereby a single full-color toner image on the intermediary transfer belt 181.

There is disposed an optical sensor 200 on the downstream side of the most downstream image forming portion Pd. The optical sensor 200 is provided for detecting the density of the toner image on the intermediary transfer belt 181 immediately after the primary transfer of the toner images onto the intermediary transfer belt 181. More specifically, four color patches, which are in the pattern for detecting the density with which a toner image is formed by the image forming portions Pa, Pb, Pc, and Pd, are formed by the image forming portions Pa, Pb, Pc, and Pd, one for one. Then, the density of each color patch (toner image) is detected by the optical sensor 200. Based on the results of the detection of the color patch densities, a control portion 130 adjusts the four development bias voltages applied to the development sleeves 121*a*, 121*b*, 121*c*, and 121*d*, one for one. The optical sensor 200 projects from its light emitting portion a beam of infrared light onto the intermediary transfer belt 181, and receives on its detection surface the light reflected by the intermediary transfer belt 181.

Referring to FIG. 2, the intermediary transfer belt 181 is an elastic laminar belt made up of three layers: a resin layer 181*a*, an elastic layer 181*b*, and a surface layer 181*c*. As the resinous material for the resin layer 181*a* which provides the intermediary transfer belt 181 with tensile strength, one or more substances chosen from the following list may be used: polycarbonate, fluorinated resin (ETFE, PVDF), polystyrene, chloro-polystyrene, poly-α-methyl-styrene, styrene-butadiene copolymer, styrene-vinyl-chloride copolymer, styrene-vinyl acetate copolymer, styrene-maleic acid copolymer, styrene-acrylic ester copolymer (styrene-methyl acrylate copolymer, styrene-ethyl acrylate copolymer, styrene-butyl acrylate copolymer, styrene-octyl acrylate copolymer, and styrene-phenyl acrylate copolymer, etc.), styrene-methacrylate ester copolymer (styrene-methyl methacrylate copolymer, styrene-ethyl methacrylate copolymer, styrene-phenyl methacrylate copolymer, etc.), styrene-α-methyl chloacrylate copolymer, styrenated resin (monomeric or copolymer which contains styrene or styrene-substitution product) such as styrene-acrylonitrile-acrylate ester copolymer, methacrylate methyl resin, butyl methacrylate resin, ethyl methacrylate resin, butyl acrylate resin, denatured acrylic resin (silicon-denatured acrylic resin, vinyl chloride-denatured acrylic resin, acrylyl urethane resin, etc.), vinyl chloride resin, styrene-vinyl acetate copolymer, vinyl chloride-vinyl acetate copolymer, rosin-denatured maleic acid resin, phenol resin, epoxy resin, polyester resin, polyester-polyurethane resin, polyethylene, polypropylene, polybutadiene, polyvinylidene, ionomer resin, polyurethane resin, silicone resin, ketone resin, ethylene-ethyl acrylate copolymer, xylene resin, polyvinyl-butyral resin, polyamide resin, polyimide resin, denatured polyphenylene oxide resin, denatured polycarbonate, etc. However, the choices do not need to be limited to those in the list given above.

As the elastic material (elastic rubber, elastomer) for the above-mentioned elastic layer 181*b* which provides the intermediary transfer belt 181 with elasticity, one or more substances chosen from the following list may be used: butyl rubber, fluorinated rubber, acrylyl rubber, EPDM, NBR, acrylonitrile-butadiene-styrene rubber, natural rubber, isopropylene rubber, styrene-butadiene rubber, ethylene-propylene rubber, ethylene-propylene-terpolymer, chloroprene rubber, chlorosulfonated polyethylene, chlorinated polyethylene, urethane rubber, syndiotactic 1,2-polybutadiene, epichlorohydrin rubber, silicone rubber, fluorinated rubber, polysulfide rubber, polynorbornene rubber, hydrogenated nitrile rubber, thermoplastic elastomer (for example, polystyrene polyolefin, polyvinylchloride, polyurethane, polyamide, polyurea, polyester, and fluorinated resins), etc. Needless to say, however, the choices do not need to be limited to those listed above.

Although there is no strict requirement regarding the material for the surface layer 181*c* on which a toner image is borne, the material for the surface layer 181 c is desired to be a substance capable of reducing as much as possible the adhesive force between the surface of the intermediary transfer belt 181 and a toner image so that the toner can be efficiently transferred (secondary transfer) away from the intermediary transfer belt 181. As the examples of the material for the surface layer 181*c*, one among polyurethane, polyethylene, epoxy resin, and the like, elastic substance (elastic rubber, elastomer), or two or more among elastic substances, such as butyl rubber, fluorinated rubber, acrylyl rubber, EPDM, NBR, acrylonitrile-butadiene-styrene rubber, natural rubber, isopropylene rubber, styrene-butadiene rubber, ethylene-propylene rubber, ethylene-propylene-polymer, chloroprene rubber, chlorosulfonated polyethylene, chlorinated polyethylene, and urethane rubber, and syndiotactic 1,2-polybutadiene, epichiorohydrin rubber, silicone rubber, fluorinated rubber, may be used, with powder of two or more substances, such as fluorinated resin, fluorine compound, fluorinated carbon, titanium dioxide, silicon carbide, and the like, which improve the surface layer 181*c* of the intermediary transfer belt 181 in lubricity by reducing the surface energy of the surface layer 181*c*, dispersed therein. Incidentally, the above-mentioned substances to be dispersed in two or more of the above-mentioned substances as the materials for the surface layer 181*c* may be uniform or nonuniform in particle size.

To the material for the resinous layer 181*a* and elastic layer of the intermediary transfer belt 181, electrically conductive agents for adjusting electrical resistance are added. There is no specific requirement for the electrical resistance adjustment agents. However, they are usually chosen from among carbon black, graphite, powder of a metallic substance (such as aluminum or nickel), and electrically conductive metallic oxides, such as, tin oxide, titanium oxide, antimony oxide, indium oxide, potassium titanate a compound of antimony oxide and tin oxide (ATO), a compound of indium oxide and tin oxide (ITO), etc. Instead of electrically conductive metallic oxides, microscopic particles of dielectric substance, such as barium sulfate, magnesium silicate, calcium carbonate, etc., which are coated with one of the above-mentioned electrically conductive metallic substances, may be used. The choices of the electrical resistance adjustment agent do not need to be limited to those listed above.

As the examples of the manufacturing methods for the intermediary transfer belt 181, there are centrifugal molding method (material is poured into rotating cylindrical mold), a spraying method (for forming think surface layer), a dipping method (cylindrical mold is dipped into material solution and pulled out), an injection molding (material is injected into space between inner and outer molds), vulcanizing-polishing method (compound is wrapped around cylindrical mold and polished), etc. However, the method for manufacturing the intermediary transfer belt 181 does not need to be limited to those listed above. Further, a combination of two or more manufacturing methods may be used to form the intermediary transfer belt 181.

After the full-color toner image is effected on the intermediary transfer belt 181 by the transfer (primary transfer) of four monochromatic toner images, different in color, onto the intermediary transfer belt 181, in the primary transferring portion T1 shown in FIG. 1, the full-color image is transferred (secondary transfer) onto the recording medium P in the secondary transferring portion T2. A secondary transfer roller 140 is connected to an unshown secondary transfer power source, and is in contact with the intermediary transfer belt 181. To the secondary transfer roller 140 (transferring means), secondary transfer bias voltage, which is positive in polarity, is applied, generating an electric field, which transfers together the four monochromatic color images (effecting full-color toner image), which are on the intermediary transfer belt 181 and are negative in polarity, onto the recording medium P which is in contact with the intermediary transfer belt 181.

The secondary transfer residual toner particles, that is, the toner particles which eluded the secondary transfer process in the secondary transfer portion T2, and therefore, are remaining on the intermediary transfer belt 181, are removed by the electrically conductive fur brushes 116*a* and 116*b*, which are the cleaning members disposed between the secondary transferring portion T2 and the most upstream primary transferring portion T1, in a manner to oppose the tension roller 126.

Referring to FIG. 3, the electrically conductive fur brushes 116*a* and 116*b* are located in the cleaning apparatus housing 117 which is in the adjacencies of the intermediary transfer belt 181. The electrically conductive fur brushes 116*a* and 116*b* are identical in structure, although they are opposite in the polarity of the cleaning bias voltage applied thereto. Thus, the electrically conductive fur brush 116*a* will be described as the representative of the two electrically conductive fur brushes 116*a* and 116*b*. The two tension rollers 126 shown in FIG. 3 are actually a single component (tension roller) common to the electrically conductive fur brushes 116*a* and 116*b* as shown in FIG. 1.

The electrically conductive fur brush 116*a* rotates in contact with the intermediary transfer belt 181. It is made up of a metallic roller, and fibrous bristles 3 planted on the peripheral surface of the metallic roller, with a density of 50,000 bristles/inch$^2$. The bristles 3 are formed of nylon in which carbon has been dispersed. They are 10 MΩ in electrical resistance, and 6 deniers in thickness. The cleaning apparatus 112*a* is provided with a pair of metallic rollers 119, which are on the opposite side of the corresponding electrically conductive fur brushes 116 from the intermediary transfer belt 181 and in contact with the corresponding electrically conductive fur brushes 116. The metallic rollers 119*a* and 119*b* are electrically conductive rollers formed of aluminum, and their surfaces have been hardened by anodization. Further, the cleaning apparatus 112*a* is provided with a pair of cleaning blades 120*a* and 120*b* which are in contact with the electrically conductive rollers 119*a* and 119*b*, one for one, to clean the electrically conductive rollers 119*a* and 119*b*.

The cleaning apparatus 112*a* structured as described above is disposed so that the electrically conductive fur brushes 116*a* and 116*b* are in parallel with the widthwise direction of the intermediary transfer belt 181. The electrically conductive fur brush 116*a* is disposed in contact with the intermediary transfer belt 181 so that it rubs the intermediary transfer belt 181 with roughly 1.0 mm of apparent intrusion of the electrically conductive fur brush 116*a* into the intermediary transfer belt 181. The electrically conductive fur brush 116*a* is rotated by an unshown motor in the direction indicated in the drawing at 50 mm/sec.

The metallic roller 119*a* is in contact with the electrically conductive fur brush 116*a*, with the apparent intrusion of roughly 1.0 mm, and is rotationally driven in the direction indicated by an arrow mark in the drawing at the same speed as the electrically conductive fur brush 116*a*. The cleaning blade 120*a*, which is in contact with the metallic roller 119*a* is formed of urethane rubber, and is in contact with the metallic roller 119*a*, with the apparent intrusion of roughly 1.0 mm.

Current detecting portions 131*a* and 131*b* are identical, and detect the amount by which electrical current flows into the tension roller 126 as two bias voltages different in polarity are applied to the electrically conductive fur brushes 116*a* and 116*b*, one for one. Electric power sources 132*a* and 132*b* output various bias voltages, which are applied to the metallic rollers 119*a* and 119*b*, while being controlled by the control portion 130.

As the bias voltages are applied to the electrically conductive fur brushes 116*a* and 116*b*, the toner on the intermediary transfer belt 181 is removed from the areas C of the intermediary transfer belt 181, which is in contact with the electrically conductive fur brushes 116*a* and 116*b*, respectively.

Next, the control sequence (ACVC), in the first preferred embodiment, for automatically setting the bias voltages will be described.

In the first preferred embodiment, the toner recovered by the electrically conductive fur brush 116*a*, or the upstream brush, and the toner recovered by the electrically conductive fur brush 116*b*, or the downstream brush, are different in polarity. Thus, the manner in which the upstream electrically conductive fur brush 116*a* and downstream electrically conductive fur brush 116*a* become soiled when the images being outputted are high in density is different from that when the image being outputted are low in density. Therefore, the two bias voltages applied to the upstream electrically conductive fur brush 116*a* and downstream electrically conductive fur brush 116*b*, one for one, must be individually adjusted.

The bias voltages are controlled to be stable at a proper (optimal) level. The proper (optimal) value for the cleaning current necessary for cleaning the secondary transfer residual toner particles on the intermediary transfer belt 181 can be determined from the changes which occur to the relationship between the amount of the cleaning current and the secondary transfer residual toner recovery efficiency, as shown in FIG. 4, as the amount of the cleaning current is varied.

More concretely, during a period in which no recording medium is being conveyed, and before the starting of the formation of an image, the bias voltage which the electric power source 132*a* is to apply to the metallic roller 119*a* is varied in steps. In each step, the amount by which electric current flows from the electrically conductive fur brush 116*a* into one of the tension rollers 126 through the intermediary transfer belt 181 is detected by the electric current detecting portion 131*a*. Then, the bias voltage is adjusted in magnitude so that the detected amount by which electric current is flowing matches the proper (optimal) current value for cleaning. As a voltage value which corresponds to the proper value for the electric current is found, this voltage value is used as the value for the bias voltage to be applied to the electrically conductive fur brush 116*a* during the following image forming operation.

For example, it is assumed that the amount by which electric current needs to flow through the upstream electrically conductive fur brush 116*a* for proper cleaning is 20 μA, and the amount by which electric current needs to flow through the downstream electrically conductive fur brush 116*b* for proper cleaning is −20 μA. In this case, the control portion 130 causes the electric power source 132*a* to apply 300 V and 900 V to the upstream electrically conductive fur brush 116*a*, as shown in FIG. 5. If the electric current values detected by the electric current detecting portion 131*a* are 10 μA and 31 μA, respectively, the control portion 130 determines, through the calculation based on the two relationships between the voltage value and current value, that the proper value for the bias voltage which causes 20 μA of electric current (cleaning current) to flow through the upstream electrically conductive fur brush 116*a* is roughly 600 V.

Then, the control portion 130 causes the electric power source 132*a* to output 550 V and 650 V of bias voltages, in order to more precisely determine the value for the bias voltage for the electrically conductive fur brush 116*a* to properly clean the intermediary transfer belt 181. If the current values detected when these two bias voltages are 18 μA and 22 μA, respectively, the control portion 130 determines, through the calculation based on the two relationships between the voltage value and current value, that the proper value for the bias voltage which causes 20 μA of cleaning current to flow is 600 V. Based on the above described computation, the control portion 130 causes the electric power source 132*a* to apply 600 V of bias voltage to the metallic roller 119*a*, achieving the proper amount, that is, 20 μA, of cleaning current, at a point t1 in time. Next, in order to cause the proper amount, that is, −20 μA, of electric current to flow through the downstream electrically conductive fur brush 116*b*, the control portion 130 carries out a control sequence similar to the above-described one so that the proper value for the bias voltage for the electrically conductive fur brush 116*b* is automatically set. That is, −300 V and −900 V of bias voltages are sequentially applied from the electrical power source 132*b*, and the sequence similar to the sequence carried out for the upstream electrically conductive fur brush 116*a* is carried out to control the value for the bias voltage to be applied to the electrically conductive fur brush 116*a*, completing the setting of the proper value for the bias voltage for the electrically conductive fur brush 116*b*, at a point t2 in time.

Next, the adjustment of the amount of the light emitted by the optical sensor 200 (detecting means, detecting apparatus), and the amount of gain, in this first embodiment will be described. Referring to FIG. 6, the optical sensor 200 reads the color patch F on the intermediary transfer belt 181 (onto which color patch F has been transferred (primary transfer)). The optical sensor 200 projects a beam of infrared light from its light emitting portion 201, and receives with its detection surface 202 the light reflected by the intermediary transfer belt 181. The control portion 130 adjusts the amount by which electric current flows through the light emitting diode 203 while reading the color patch F. Then, it adjusts the amount by which electric current flows through the light emitting diode 203 so that the intensity of the light which was received by the light receiving portion 204 after being reflected by the intermediary transfer belt 181 converges to the target value.

Referring to FIG. 10, the control portion 130 makes the light emitting diode 203 emit light while varying the current value in six steps, and derives a linear equation which shows the relationship between the amount of emitted light and the amount of received light, based on the amounts of the light received using the above-mentioned six current values. Then, it calculates the proper current value for causing the light emitting diode 203 to emit the target amount of light. At the same time, it adjusts its light receiving portion in gain, based on the amount of the received light.

Incidentally, in this embodiment, the optical sensor 200 is adjusted in both the amount of light and gain. However, it may be adjusted in only one of the two factors.

The image forming apparatus 100 is equipped with the control portion 130 (voltage adjusting means, controlling means), which is a controlling apparatus based on a computer. The control portion 130 reads various control timings from the control timing charts stored in an unshown backup RAM, and coordinates the various control timings, for example, the control timing for setting the proper values for the bias voltages for the electrically conductive fur brushes 116*a* and 116*b*, timings for starting to rotate the development sleeves 121*a*-121*d*, and timings for adjusting the optical sensor in the amount of light and gain.

Referring to FIG. 7, as the control portion 130 receives a command for starting up a job after the image forming apparatus 100 is turned on, it starts the job (S11). First, it sets the bias voltages for the electrically conductive fur brushes 116*a* and 116*b* while keeping in motion the intermediary transfer belt 181 and photosensitive drums 101*a*-101*d* (S12). Then, it waits for a certain length of time, and starts rotating the development sleeves 121*a*-121*d*, with the timing which will be described later (S13). Then, it adjusts the optical sensor 200 in the amount of light and gain, using another timing, that is the timing, which is different from the timing used in Step S13 and will also be described later (S14). Then, it ends the startup job (S15).

The control portion 130 controls the length of time it takes for the intermediary transfer belt 181 to convey the toner image to the point at which the toner image is read by the optical sensor 200, after the transfer of the toner image onto the intermediary transfer belt 181.

Referring to FIG. 8, it is assumed that the distance from the primary transfer portion T1 which corresponds to the most upstream photosensitive drum 101*a* to the optical sensor 200 is L (mm), and the distance from the electrically conductive fur brush 116*b* to the primary transfer portion T1 for the photosensitive drum 101*a* is Lcln·1tr (mm). Further, it is assumed that the distance from the development nip between the photosensitive drum 101*a* and development sleeve 121*a* to the primary transfer portion T1 for the photosensitive drum 101*a* is Lsl·1tr (mm), and the speed (process speed) at which the intermediary transfer belt 181 is circularly moved is P (mm/sec). Further, it is assumed that the peripheral velocity of the photosensitive drum 101*a* is V (mm/sec). In this embodiment, L is 750 mm; Lcln·1tr, 250 mm; Lsl·1tr, 80 mm; P, 300 mm; and V is 292.5 mm/sec.

After the control portion 130 selects the value for the bias voltage for the electrically conductive fur brush 116*a*, it starts rotating the development sleeve 121*a* within [(Lcln ·1tr/P)−(Lsl·1tr/V)] seconds after the selection. While the development sleeves 121 a rotates, the area of the peripheral surface of the photosensitive drum 101*a*, which opposes the development sleeves 121*a*, is holding the electric charge given by the primary charging device 122*a*. During this rotation a voltage is applied to the development sleeve 121*a*.

Further, the control portion 130 adjusts the optical sensor 200, in the amount by which the optical sensor 200 emits light, between the point in time which is [(Lcln·1tr+L)/P] seconds after it selects the value for the bias voltage for the electrically conductive fur brush 116*b*, and the point in time at which the color patch F (FIG. 6) on the intermediary transfer belt 181 reaches the point where the optical sensor 200 reads the color patch F.

Further, the development sleeve 121*a* rotates during the period between the point in time which is [(Lcln·1tr/P)−(Lsl·1tr/V)] seconds after the adjustment of the bias voltage based on the selected value, and the point in time which is [(L/P)+(Lcln·1tr/VP)] seconds before the color patch F reaches the point where the optical sensor 200 reads the color patch F.

With the employment of the above-described control sequence, it is possible to reduce the amount of the effects which the toner particles which are expelled from the electrically conductive fur brushes 116*a* and 116*b* onto the intermediary transfer belt 181 have, and also, to adjust the optical sensor 200 in the amount of the light and the gain, while taking into consideration the effects of the fog generating toner particles which are generated because the development sleeve 121*a* begins to rotate.

That is, the light for adjusting the amount by which the light to be projected from the optical sensor 200, and also, for adjusting the gain of the optical sensor 200, is projected from the optical sensor 200 during the period between the point in time when the areas of the intermediary transfer belt 181, which are in contact with the electrically conductive fur brushes 116*a* and 116*b* immediately before the cleaning bias voltages are set, passes the reading position (detection position), and the point in time when the toner image reaches the reading position.

The emission of the light for adjusting the optical sensor 200 in the amount of light and gain is delayed until the area of the intermediary transfer belt 181, which is in contact with the electrically conductive fur brushes 116*a* and 116*b* while the voltage with the proper value determined through the above described control sequence for determining the proper value for the cleaning bias voltage are applied to the electrically conductive fur brushes 116*a* and 116*b*, reaches the reading position; the light for adjusting the optical sensor 200 is emitted as soon as the above-mentioned area of the intermediary transfer belt 181 reaches the reading position. Incidentally, during the period between the completion of the control sequence for determining the proper value for the cleaning bias voltage, and when the cleaning bias of the proper value begins to be applied, the electrically conductive fur brushes 116*a* and 116*b* do not contact the secondary transfer residual toner particles, and therefore, they do not remove the secondary transfer residual toner particles. Further, it is the area of the intermediary transfer belt 181, across which no toner image is present (area free of toner image), that the beam of light for adjusting the optical sensor 200 in the amount by which the beam of light is to be projected, and also, for adjusting the gain, is projected.

During this period, the beam of light for adjusting the optical sensor 200 in the amount by which light is to be projected from the optical sensor 202 is projected onto the area of the intermediary transfer belt 181, which was in the primary transferring portion T1 at the same time as the area of the peripheral surface of the photosensitive drum 101*a*, which was opposing the rotating development sleeves 121*a*, was in the primary transferring portion T1.

FIG. 9 is a timing chart which shows the point in time when the steps S11-S15 shown in FIG. 7 are started.

In this embodiment, the control sequence for determining the proper value for the cleaning bias voltage, based on the amount of the electrical current which flows the electrically conductive fur brushes 116*a* and 116*b* as the voltage is applied to the metallic rollers 119*a* and 119*b*, is carried out each time the cumulative length of the operational time of the image forming apparatus reaches the value equivalent to the formation of 4,000 copies of A4 size.

Embodiment 2

Next, a second preferred embodiment of the present invention will be described. The image forming apparatus in the second preferred embodiment of the present invention is similar in structure to the image forming apparatus in the first preferred embodiment. In other words, this embodiment is only slightly different from the first one in the method for adjusting the optical sensor 200 in the amount by which it emits light, and the gain. Therefore, this preferred embodiment will be described with reference to the same drawings, that is, FIGS. 1-10.

Hereafter, the adjustment of the optical sensor 200 in the amount by which it emits light, and the gain, will be described. Referring to FIG. 6, the optical sensor 200 projects from its light emitting portion 201 a beam of infrared light, and receives by its detection surface 202 the reflected light. The control portion 130 (FIG. 1) adjusts the amount by which light is to be emitted by the optical sensor 200, so that the amount of the light which is reflected by the intermediary transfer belt 181 and received by the light receiving portion 204 converges to the target value. More specifically, six values are pre-selected for the amount of current which is flows through the light emitting diode 203, and the amount by which light is emitted by the light emitting diode 203 is increased in step using the pre-selected six values, starting from the smallest value (smallest amount of light). Then, the control portion 130 (FIG. 1) selects the value which makes the amount of light received by the light receiving portion 204 exceed a certain value, as the value for adjusting the optical sensor 200 in the amount of light.

Referring to FIG. 7, it is assumed, also in this second embodiment, that the distance from the primary transfer portion T1 for the most upstream photosensitive drum 101*a* to the optical sensor 200 is L (mm), and the distance from the electrically conductive fur brush 116*b* to the primary transfer T1 for the photosensitive drum 101*a* is Lcln·1tr (mm). Further, it is assumed that the distance from the development nip between the photosensitive drum 101*a* and development sleeve 121*a* to the primary transfer portion T1 for the photosensitive drum 101*a* is Lsl·1tr (mm), and the speed (process speed) at which the intermediary transfer belt 181 is circularly moved is P (mm/sec). Further, it is assumed that the peripheral velocity of the photosensitive drum 101*a* is V (mm/sec).

The control portion 130 starts rotating the development sleeves 121*a* within at least [(Lcln·1tr−Lsl·1tr)/P)] seconds after the completion of the control sequence (ACVC) for selecting the proper value for the bias voltage for the electrically conductive fur brush 116*a*. Then, the control portion 130 adjusts the optical sensor 200 in the amount of light, during the period between the point in time which is [(Lcln·1tr+L)/P] seconds after the completion of the ACVC, and the point in time at which the toner image on the intermediary transfer belt 181 reaches the point where the optical sensor 200 reads the toner image. With the employment of the control sequence, it is possible to nullify the effects of the toner particles which remain on the intermediary transfer belt 181, and also, to adjust the optical sensor 200 in the amount of the light, while taking into consideration the effects of the fog generating toner which is generated because the development sleeve 121*a* begins to rotate.

The image forming apparatus 100 in the first embodiment has: the circularly movable intermediary transfer belt 181; image forming portion Pa for forming a toner image on the intermediary transfer belt 181 in the primary transfer portion T1; secondary transfer roller 140 for transferring the toner image on the intermediary transfer belt 181 onto the recording medium P; electrically conductive fur brushes 116*a* and 116*b* which are in contact with the intermediary transfer belt 181, and remove the toner on the intermediary transfer belt 181 as the cleaning bias is applied to them, at the cleaning points; electric power sources 132*a* and 132*b* which are controlled in the conditions under which they apply cleaning biases; optical sensor 200 which optically detects the toner image which is formed on the intermediary transfer belt 181 to be detected; control portion 130 which controls the cleaning biases to be applied to the electrically conductive fur brushes 116*a* and 116*b*, based on the relationship which occurs between the values of the test bias voltages applied to the electrically conductive fur brushes 116*a* and 116*b* and the amount of the electric current flowing through the electrically conductive fur brushes 116*a* and 116*b*; control portion 130 which adjusts the optical sensor 200 in the amount by which the optical sensor 200 emits for the actual detection, by projecting the test detection light onto the intermediary transfer belt 181. It is during the period between when the area of the intermediary transfer belt 181, which is at the cleaning area while the cleaning biases (voltages) having the proper values determined through the preceding control sequence are applied to the electrically conductive fur brushes 116*a* and 116*b*, passes the detection point, and when the toner image for detection reaches the detection point, that the light is emitted from the optical sensor 200 to adjust the optical sensor 200.

In the case of the image forming apparatus 100 in this embodiment, at least one of the two control sequences, that is, the sequence in which the optical sensor 200 is automatically adjusted for optical detection, and sequence in which the optical sensor 200 detects the toner image for testing, is carried out using the area of the intermediary transfer belt 181, which is on the downstream side of the electrically conductive fur brushes 116*b* when the bias voltage is properly set. Further, at least one of the two control sequences, that is, the sequence in which the optical sensor 200 is automatically adjusted for optical detection, and the sequence in which the optical sensor 200 detects the toner image (test pattern), using the area of the intermediary transfer belt 181, which was not soiled by being used for automatically selecting the proper bias voltage (area of intermediary transfer belt 181, which is free of such toner as toner which the cleaning operation failed to remove).

Therefore, the contamination of the intermediary transfer belt 181, which is attributable to the automatic adjustment of the bias voltage, does not adversely affect the automatic adjustment of the optical sensor, or the detection of the toner image (test pattern).

The image forming portion Pa of the image forming apparatus 100 has: the photosensitive drum 101*a* which rotationally moves while bearing an electrostatic image; and the developing device 123*a* which forms a toner image by developing the electrostatic image by applying voltage to the development sleeve 121*a* which is rotating with toner borne on its peripheral surface. The afore-mentioned light for detection is projected onto the area of the intermediary transfer belt 181, which was in the primary transferring portion T1 at the same time as the area of the rotating peripheral surfaces 121*a*, which opposing the photosensitive drum 101*a*, was in the primary transferring portion T1.

The image forming portion Pa of the image forming apparatus 100 also has the primary transfer roller 124*a* which transfers (primary transfer) the toner image, that is, the developed electrostatic image, on the photosensitive drum 101*a*, onto the intermediary transfer belt 181, in the primary transferring portion T1. The control portion 130 starts rotating the development sleeves 121*a* after the ultimate (optimal) cleaning bias begins to be applied to the electrically conductive fur brushes 116*a* and 116*b*. The control portion 130 starts rotating the development sleeves 121*a* so that the area of the peripheral surface of the photosensitive drum 101*a*, which is in contact with the development sleeves 121*a* when the rotation of the development sleeves 121*a* is started, passes the primary transferring portion T1 by the time the area of the intermediary transfer belt 181, which is at the cleaning point when the ultimate (optimal) cleaning bias voltages begin to be applied to the electrically conductive fur brushes 116*a* and 116*b* passes the primary transferring portion T1. With the employment of this control sequence, the toner particles which adhered to the photosensitive drum 101*a* at the beginning of the rotation of the development sleeves 121*a* and are likely to cause the image forming apparatus to form a foggy image, are transferred (primary transfer) onto the area of the intermediary transfer belt 181, which is on the upstream side of the point at which the intermediary transfer belt 181 will be cleaned by the electrically conductive fur brushes 116*a* and 116*b* to which the ultimate (optimal) cleaning bias voltage will be being applied. The process for automatically adjusting the optical sensor 200 to prepare it for optical detection is carried out using the area of the intermediary transfer belt 181, which has just been cleaned by the electrically conductive fur brushes 116*a* and 116*b* to which the ultimate (optimal) cleaning bias voltage was being applied. Therefore, the toner particles which were transferred (primary transfer) onto the area of the intermediary transfer belt 181, which was on the upstream side of the point at which the intermediary transfer belt 181 was cleaned, and therefore, are likely to cause the image forming apparatus to yield a foggy image, do not affect the automatic adjustment related to the optical detection.

The image forming apparatus 100 is provided with: the intermediary transfer belt 181 onto which the toner image formed on the photosensitive drum 101*a* is transferred (primary transfer), and which is moved while bearing the transferred toner image; secondary transfer roller 129 which transfers the toner image borne on the intermediary transfer belt 181, onto the transfer medium, on the downstream side of the photosensitive drum 101*a*; electrically conductive fur brushes 116*a* and 116*b* which remove the secondary transfer residual toner particles on the moving intermediary transfer belt 181 as bias voltage is applied to them, while the area of the intermediary transfer belt 181, which has the secondary transfer residual toner particles, is moving between the secondary transfer roller 129 and photosensitive drum 101*a*. It is also provided with: the optical sensor 200 which optically detects the toner image on the intermediary transfer belt 181, on the downstream side of the photosensitive drum 101*a*; control portion 130 which automatically selects a proper value for the bias voltage for cleaning the intermediary transfer belt 181 by varying the bias voltage; and control portion 130 which carries out the process for automatically setting (adjusting) the optical sensor for proper optical detection, after the area of the intermediary transfer belt 181, which was at the location of the electrically conductive fur brush 116b after the process for setting the proper value for the bias voltage to be applied for cleaning of the intermediary transfer belt 181 is completed, passes the optical sensor 200.

The image forming apparatus 100 is provided with: the image forming portion Pa which forms a toner image on the photosensitive drum 101*a*; and the control portion forms a color patch F used for adjusting the density with which a toner image is formed, by controlling the image forming portion Pa. The control portion 130 automatically adjusts the density with which a toner image is going to be formed, based on the results of the detection of the color patch F by the optical sensor 200. The area (in terms of rotational phase) of the peripheral surface of the photosensitive drum 101*a*, across which the control portion 130 causes the image forming portion Pa to form the color patch F, is such an area of the peripheral surface of the photosensitive drum 101*a* that will be on the downstream side of the area of the intermediary transfer belt 181, which is at the location of the optical sensor 200 when the above-mentioned automatic setting related to the optical detection is completed, by the time the color patch F begins to be transferred (primary transfer) onto the intermediary transfer belt 181.

The cleaning apparatus has: the electrically conductive fur brush 116*b* which is in contact with the surface of the intermediary transfer belt 181; the metallic roller 119*b* which charges the electrically conductive fur brush 116*b* by being in contact with the electrically conductive fur brush 116*b*, at a point different from the point at which the electrically conductive fur brush 116*b* is in contact with the intermediary transfer belt 181, in terms of the rotational phase of the electrically conductive fur brush 116*b*; and the electrical power source 132*b* which is capable of applying various bias voltages to the metallic roller 119*b*.

The intermediary transfer belt 181 of the image forming apparatus 100 is in the form of an endless belt wrapped around the driving roller 125, tension roller 126, and is circularly moved. The image forming apparatus 100 is provided with: multiple photosensitive drums 101, more specifically, 101*a*, 101*b*, 10*c*, and 101*d*, which are juxtaposed along the surface of the intermediary transfer belt 181 in the direction parallel with the moving direction of the intermediary transfer belt 181; and development sleeves 121*a*, 121*b*, 121*c*, and 121*d*, on which toner different in color are borne, one for one, and which are used for developing toner images formed on the multiple photosensitive drums 101, one for one.

Assuming that the distance from the most upstream nip between the photosensitive drum 101 and primary transfer roller 124, in terms of the moving direction of the intermediary transfer belt 181, that is, the nip between the photosensitive drum 101*a* and primary transfer roller 124*a*, to the optical sensor 200 is L (mm); the distance from the electrically conductive fur brush 116*b* to the above-mentioned nip is Lcln·1tr (mm); the distance from the point at which the most upstream photosensitive drum 101*a* is in contact with the development sleeves 121*a* to the above-mentioned nip is Lsl·1tr (mm); and the speed at which the intermediary transfer belt 181 is circularly moved is P (mm/sec), the control portion 130 starts rotating the development sleeves 121 a within a minimum of [Lcln·1tr−Lsl·1tr)/P] seconds after the setting a proper value for the bias voltage. Further, the control portion 130 finishes the process for automatically setting the optical sensor for proper optical detection, between the point in time which is [(Lcln·1tr+L)/P] seconds after the setting of a proper value for the bias voltage, and the point in time when the color patch F transferred onto the intermediary transfer belt 181 from the most upstream photosensitive drum 101*a* reaches the optical sensor 200.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 096931/2006 filed Mar. 31, 2006 which is hereby incorporated by reference.

What is claimed is:

1. An image forming apparatus comprising:

a rotatable image bearing member for carrying a toner image;

toner image forming means for forming the toner image on said image bearing member, wherein said image forming means is capable of forming a detection toner image on said image bearing member;

transferring means for transferring the toner image from said image bearing member onto a recording material;

a cleaning member for removing untransferred toner remaining on said image bearing member after the toner image is transferred onto the recording material, wherein said cleaning member is supplied with a cleaning voltage while contacting said image bearing member;

voltage adjusting means for adjusting the cleaning voltage on the basis of a current which flows when said cleaning member is supplied with a predetermined voltage;

a detecting device for optically detecting the detection toner image formed on said image bearing member at a detecting position and illuminated with light;

image forming control means for controlling a toner image forming condition of said toner image forming means on the basis of a result of detection of said detecting device;

detecting device adjusting means for adjusting at least a quantity of the illuminating light or a gain of said detecting device; and a controller for controlling an operation timing of said voltage adjusting means and said detecting device adjusting means so that when said detecting device adjusting means is to be operated before the detecting device detects the detection toner image, said voltage adjusting means is operated, and then said detecting device adjusting means is operated for an area of said image bearing member cleaned by said cleaning means with the voltage adjusted by said voltage adjusting means, and thereafter, said detecting device detects the detection toner image.

2. An apparatus according to claim 1, wherein said toner image forming means includes a movable electrostatic image bearing member for carrying an electrostatic image, and a developing device for developing an electrostatic image into a toner image by applying a voltage to a toner carrying member rotating while carrying toner, wherein said detecting device emits light to a portion of said image bearing member contacted to a portion of said electrostatic image bearing member opposed to said image bearing member which is rotating, to adjust a light emission quantity.

3. An apparatus according to claim 2, wherein said image bearing member is an endless belt member carried on a plurality of rotatable members.

4. An apparatus according to claim 1, wherein said cleaning member includes a rotatable fur brush.

5. An apparatus according to claim 2, wherein said toner carrying member starts to rotate after the operation of said voltage adjusting means and before the operation of said detecting device adjusting means.

6. An apparatus according to claim 2, said toner carrying member starts to rotate at a predetermined timing after completion of the operation of said voltage adjusting means, and thereafter, the operation of said detecting device adjusting means is started.

7. An apparatus according to claim 1, wherein said cleaning member includes a first cleaning member, and a second cleaning member, provided downstream of said first cleaning member with respect to a moving direction of said image bearing member, for removing toner from said image bearing member by a voltage applied thereto, and said voltage adjusting means adjusts the voltage applied to said first cleaning member and the voltage applied to said second cleaning member.

8. An apparatus according to claim 7, wherein said controller controls the operation timing of said voltage adjusting means and said detecting device adjusting means so that when said detecting device adjusting means is operated before the detection toner image, said voltage adjusting means is operated for the first cleaning means and said second cleaning means, and then said detecting device adjusting means is operated for an area of said image bearing member cleaned by said first cleaning member and said second cleaning member with the voltage adjusted by said voltage adjusting means, and thereafter, said detecting device detects the detection toner image.

* * * * *